US007810922B2

(12) United States Patent
Gervasi et al.

(10) Patent No.: US 7,810,922 B2
(45) Date of Patent: Oct. 12, 2010

(54) PHASE CHANGE INK IMAGING COMPONENT HAVING CONDUCTIVE COATING

(75) Inventors: David J Gervasi, Pittsford, NY (US); Santokh S Badesha, Pittsford, NY (US); James E Williams, Penfield, NY (US); Paul J Mcconville, Webster, NY (US); Jignesh P Sheth, Wilsonville, OR (US)

(73) Assignee: Xerox Corporation, Norwalk, CT (US)

( * ) Notice: Subject to any disclaimer, the term of this patent is extended or adjusted under 35 U.S.C. 154(b) by 188 days.

(21) Appl. No.: 12/177,952

(22) Filed: Jul. 23, 2008

(65) Prior Publication Data

US 2010/0018417 A1 Jan. 28, 2010

(51) Int. Cl.
*B41J 2/01* (2006.01)

(52) U.S. Cl. ..... 347/103; 347/88; 347/99; 101/217

(58) Field of Classification Search ..... 347/103
See application file for complete search history.

(56) References Cited

U.S. PATENT DOCUMENTS

| | | | | |
|---|---|---|---|---|
| 4,538,156 | A | 8/1985 | Durkee et al. | |
| 4,889,560 | A | 12/1989 | Jaeger et al. | |
| 5,195,430 | A | 3/1993 | Rise | |
| 5,212,032 | A * | 5/1993 | Wilson et al. | 430/65 |
| 5,345,863 | A | 9/1994 | Kurata et al. | |
| 5,389,958 | A | 2/1995 | Bui et al. | |
| 5,406,315 | A | 4/1995 | Allen et al. | |
| 5,502,476 | A | 3/1996 | Neal et al. | |
| 5,659,854 | A * | 8/1997 | Masuda et al. | 399/176 |
| 5,777,650 | A | 7/1998 | Blank | |
| 5,793,398 | A | 8/1998 | Hennig | |
| 5,808,645 | A | 9/1998 | Reeves et al. | |
| 5,919,839 | A | 7/1999 | Titterington et al. | |
| 6,113,231 | A | 9/2000 | Burr et al. | |
| 6,174,937 | B1 | 1/2001 | Banning et al. | |
| 6,196,675 | B1 | 3/2001 | Deily et al. | |
| 6,309,453 | B1 | 10/2001 | Banning et al. | |
| 6,361,230 | B1 | 3/2002 | Crystal et al. | |
| 6,485,140 | B1 | 11/2002 | Lidke et al. | |
| 6,494,570 | B1 | 12/2002 | Snyder | |
| 6,908,664 | B2 | 6/2005 | Tsiarkezos | |
| 2003/0235838 | A1 | 12/2003 | Keating et al. | |
| 2006/0038869 | A1 | 2/2006 | Pan et al. | |
| 2006/0238585 | A1 * | 10/2006 | Kohne et al. | 347/88 |
| 2006/0238586 | A1 | 10/2006 | Kohne et al. | |
| 2007/0075296 | A1 * | 4/2007 | DeJesus et al. | 252/500 |

* cited by examiner

*Primary Examiner*—Matthew Luu
*Assistant Examiner*—Rut Patel
(74) *Attorney, Agent, or Firm*—Pillsbury Winthrop Shaw Pittman LLP

(57) ABSTRACT

Herein includes an offset printing apparatus for transferring and optionally fixing a phase change ink onto a print medium including a) a phase change ink application component for applying a phase change ink in a phase change ink image to an imaging member; b) an imaging member for accepting, transferring and optionally fixing the phase change ink image to the print medium, the imaging member having i) an imaging substrate, and thereover ii) an outer coating with a urethane and a conductive salt; and c) a release agent management system for supplying a release agent to the imaging member, wherein an amount of release agent needed for transfer and optionally fixing the phase change ink image is reduced.

21 Claims, 7 Drawing Sheets

PHASE CHANGE INK IMAGING COMPONENT HAVING CONDUCTIVE COATING

CROSS REFERENCE TO RELATED APPLICATIONS

Attention is directed to U.S. Application Ser. No. 12/177,965, filed Jul. 23, 2008, entitled "Electrically Conductive Pressure Roll Surfaces for Phase-Change Ink-Jet Printer for Direct on Paper Printing;" U.S. Application Ser. No. 12/177,987, filed Jul. 23, 2008, entitled, "Phase Change Ink Imaging Component Having Two-Layer Configuration;" U.S. Application Ser. No. 12/178,016, filed Jul. 23, 2008, entitled, "Pressure Roller Two-Layer Coating for Phase-Change Ink-Jet Printer for Direct on Paper Printing." The subject matter of these applications is hereby incorporated by reference in their entireties.

BACKGROUND

Herein is disclosed a phase change ink imaging/transfix component and layers thereof, for use in offset printing or ink jet printing apparatuses. In embodiments, the imaging component is responsible for a) accepting an ink image, and b) transfer of the ink image (imaging member), or c) transfer and fusing (transfix member) of the developed image to a print medium or copy substrate. The phase change imaging/transfix component can be used in combination with phase change inks such as solid inks. In further embodiments, the conductivity in these surface(s) can be imparted by the addition of either ionic salts, electronically conducting particles, combinations thereof, or the like.

Ink jet printing systems using intermediate transfer, transfix or transfuse members are well known, such as that described in U.S. Pat. No. 4,538,156. Generally, the imaging member, transfix printing or intermediate transfer member is employed in combination with a printhead. A final receiving surface or print medium is brought into contact with the printing surface after the image has been placed thereon by the nozzles of the printhead. The image is then transferred and fixed to a final receiving surface.

More specifically, the phase-change ink transfer printing process begins by first applying a thin liquid, such as, for example, silicone oil, to an imaging member surface. The solid or hot melt ink is placed into a heated reservoir where it is maintained in a liquid state. This highly engineered ink is formulated to meet a number of constraints, including low viscosity at jetting temperatures, specific visco-elastic properties at component-to-media transfer temperatures, and high durability at room temperatures. Once within the printhead, the liquid ink flows through manifolds to be ejected from microscopic orifices through use of proprietary piezoelectric transducer (PZT) printhead technology. The duration and amplitude of the electrical pulse applied to the PZT is very accurately controlled so that a repeatable and precise pressure pulse can be applied to the ink, resulting in the proper volume, velocity and trajectory of the droplet. Several rows of jets, for example four rows, can be used, each one with a different color. The individual droplets of ink are jetted onto the liquid layer on the imaging member. The imaging member and liquid layer are held at a specified temperature such that the ink hardens to a ductile visco-elastic state.

After depositing the image, a print medium is heated by feeding it through a preheater and into a nip formed between the imaging member and a pressure member, either or both of which can also be heated. A high durometer synthetic pressure member is placed against the imaging member in order to develop a high-pressure nip. As the imaging member rotates, the heated print medium is pulled through the nip and is pressed against the deposited ink image with the help of a pressure member, thereby transferring the ink to the print medium. The pressure member compresses the print medium and ink together, spreads the ink droplets, and fuses the ink droplets to the print medium. Heat from the preheated print medium heats the ink in the nip, making the ink sufficiently soft and tacky to adhere to the print medium. When the print medium leaves the nip, stripper fingers or other like members, peel it from the printer member and direct it into a media exit path.

To optimize image resolution, the transferred ink drops should spread out to cover a predetermined area, but not so much that image resolution is compromised or lost. The ink drops should not melt during the transfer process. To optimize printed image durability, the ink drops should be pressed into the paper with sufficient pressure to prevent their inadvertent removal by abrasion. Finally, image transfer conditions should be such that nearly all the ink drops are transferred from the imaging member to the print medium. Therefore, it is desirable that the imaging member have the ability to transfer the image to the media sufficiently.

The imaging member is multi-functional. First, the ink jet printhead prints images on the imaging member, and thus, it is an imaging member. Second, after the images are printed on the imaging member, they can then be transfixed or transfused to a final print medium. Therefore, the imaging member provides a transfix or transfuse function, in addition to an imaging function.

In duplex machines, maintenance oils, release oils, release agents, fuser oils, fuser agents, and the like, are normally used in order to provide appropriate transfix function. However it can be difficult to control the amount of release agent on the pressure member and the imaging/transfix member. The oil level on the pressure member, as transferred by contact with the imaging/transfix member or by carryout in an inked portion of the printed image, is a major cause of ghosting and duplex drop out.

Much of duplex print quality in phase change ink printers is driven by oil levels, both on the pressure member and on the imaging member. While many coatings may be oleophobic, they do not have the physical integrity to withstand prolonged printing cycles, or duplex cycling. Therefore, it is desired to provide a composite coating, which combines oleophobic properties with very good physical properties such as toughness and adhesion to the substrate.

Several coatings for the imaging member have been suggested.

U.S. Pat. No. 5,389,958 is an example of an indirect or offset printing architecture that uses phase change ink. The ink is applied to an intermediate transfer surface in molten form, having been melted from its solid form. The ink image solidifies on the liquid intermediate transfer surface by cooling to a malleable solid intermediate state as the drum continues to rotate. When the imaging has been completed, a transfer roller is moved into contact with the drum to form a pressurized transfer nip between the roller and the curved surface of the intermediate transfer surface/drum. A final receiving web, such as a sheet of media, is then fed into the transfer nip and the ink image is transferred to the final receiving web.

U.S. Pat. Nos. 5,777,650; 6,494,570; and 6,113,231 show the application of pressure to ink-jet-printed images. U.S. Pat. Nos. 5,345,863; 5,406,315; 5,793,398; 6,361,230; and 6,485,140 describe continuous-web ink-jet printing systems.

U.S. Pat. No. 5,195,430 discloses a pressure fixing apparatus for ink jet inks having 1) an outer shell of rigid, non-compliant material such as steel, or polymer such as acetal homopolymer or Nylon 6/6, and 2) an underlayer of elastomer material having a hardness of about 30 to 60, or about 50 to 60, which can be polyurethane (VIBRATHANE, or REN:C:O-thane).

U.S. Pat. No. 5,502,476 teaches a pressure roller having a metallic core with elastomer coating such as silicones, urethanes, nitriles, or EPDM, and an intermediate transfer member surface of liquid, which can be water, fluorinated oils, glycol, surfactants, mineral oil, silicone oil, functional oils such as mercapto silicone oils or fluorinated silicone oils or the like, or combinations thereof.

U.S. Pat. No. 5,808,645 discloses a transfer roller having a metallic core with elastomer covering of silicone, urethanes, nitrites, and EPDM.

U.S. Patent Publication No. 20030235838 discloses an offset printing machine having an imaging member with an outer coating that may comprise a polyurethane thermoset.

U.S. Patent Publication No. 20060038869 discloses an offset printing machine having an imaging member with an outer coating that may comprise a polyurethane thermoset.

U.S. Patent Publication No. 20060238586 discloses an offset printing apparatus having a transfix pressure member with a substrate and an outer layer having a polyurethane material, wherein the polyurethane outer layer has a modulus of from about 8 to about 300 Mpa, a thickness of from about 0.3 to about 10 mm, and wherein the pressure exerted at the nip is from about 750 to about 4,000 psi, and wherein the outer layer has a convex crown.

It is desired to provide an imaging/transfix member for use with phase change ink printing machines, including duplex machines and direct-on-paper, direct-on-web, or continuous web machines, which improves the problem of gloss alterations to the image that can be overall or patterned (ghosting), and ink offset to the imaging/transfix roll surface, which can be re-deposited back onto the copy substrate. It is desired that the imaging/transfix roller maintain the functional properties required for roll performance, while satisfying the electrical conductivity or static dissipation requirements. It is also desired that the transfix member, when heated to the operating temperature, be thermally stable. Moreover, it is desired to provide an imaging/transfix roller that is wear-resistant, has consistent mechanical properties under high load, resists adhesion of ink, and is conductive.

SUMMARY

Included herein, in embodiments, is an offset printing apparatus for transferring and optionally fixing a phase change ink onto a print medium including a) a phase change ink application component for applying a phase change ink in a phase change ink image to an imaging member; b) an imaging member for accepting, transferring and optionally fixing the phase change ink image to the print medium, the imaging member comprising i) an imaging substrate, and thereover ii) an outer coating comprising a urethane and a conductive salt; and c) a release agent management system for supplying a release agent to the imaging member, wherein an amount of release agent needed for transfer and optionally fixing the phase change ink image is reduced.

Also included is an offset printing apparatus for transferring and optionally fixing a phase change ink onto a print medium comprising a) a phase change ink application component for applying a phase change ink in a phase change ink image to an imaging member; b) an imaging member for accepting, transferring and optionally fixing the phase change ink image to the print medium, the imaging member comprising: i) an imaging substrate, and thereover ii) an outer coating comprising a polyester-based polyurethane and a transition metal salt, wherein the outer layer has an electrical conductivity of from about $10^3$ to about $10^8$ ohm-cm; and c) a release agent management system for supplying a release agent to the imaging member, wherein an amount of release agent needed for transfer and optionally fixing the phase change ink image is reduced.

In addition, included herein, in embodiments, is an offset printing apparatus for transferring and optionally fixing a phase change ink onto a print medium comprising a) a phase change ink application component for applying a phase change ink in a phase change ink image to an imaging member; b) an imaging member for accepting, transferring and optionally fixing the phase change ink image to the print medium, the imaging member comprising: i) an imaging substrate, and thereover ii) an outer coating comprising a polyurethane and ionically conductive salt, wherein the outer layer has an electrical conductivity of from about $10^3$ to about $10^8$ ohm-cm; and c) a release agent management system for supplying a release agent to the imaging member, wherein an amount of release agent needed for transfer and optionally fixing the phase change ink image is reduced.

BRIEF DESCRIPTION OF THE DRAWINGS

The above embodiments will become apparent as the following description proceeds upon reference to the drawings, which include the following figures.

DETAILED DESCRIPTION

Herein is disclosed an offset printing apparatus useful with phase-change inks such as solid inks, and comprising a coated imaging/transfix member capable of accepting and transferring, or accepting, transferring and fixing an ink image to a print medium. In embodiments, the current imaging/transfix member can be used in duplex machines. The process of transferring and fixing by the same component is sometimes referred to as "transfix" or "transfuse." If the imaging member is used in combination with separate fusing station, then the member is termed "imaging member" herein. If the member is responsible for both transfer and fixing, then the member is referred to as "transfix member" herein. For general discussions of both members, the term "imaging/transfix member" or "transfix/imaging member" will be used throughout.

The imaging/transfix member can be a roller such as a drum, or a film component such as a film, sheet, belt or the like. In embodiments, the imaging/transfix member is an imaging/transfix drum. In embodiments, the imaging/transfix member comprises a substrate and an outer layer comprising a urethane material and a conductive salt. In an alternative embodiment, the imaging/transfix member comprises a substrate, an optional intermediate layer, and outer layer comprising a urethane and conductive salt. The substrate, intermediate layer, and/or outer layer can further comprise fillers dispersed or contained therein.

The details of embodiments of phase-change ink printing processes are described in the patents referred to above, such as U.S. Pat. Nos. 5,502,476; 5,389,958; 6,908,664; and 6,196,675 B1, the disclosures of each of which are hereby incorporated by reference in their entirety.

Figure 1:
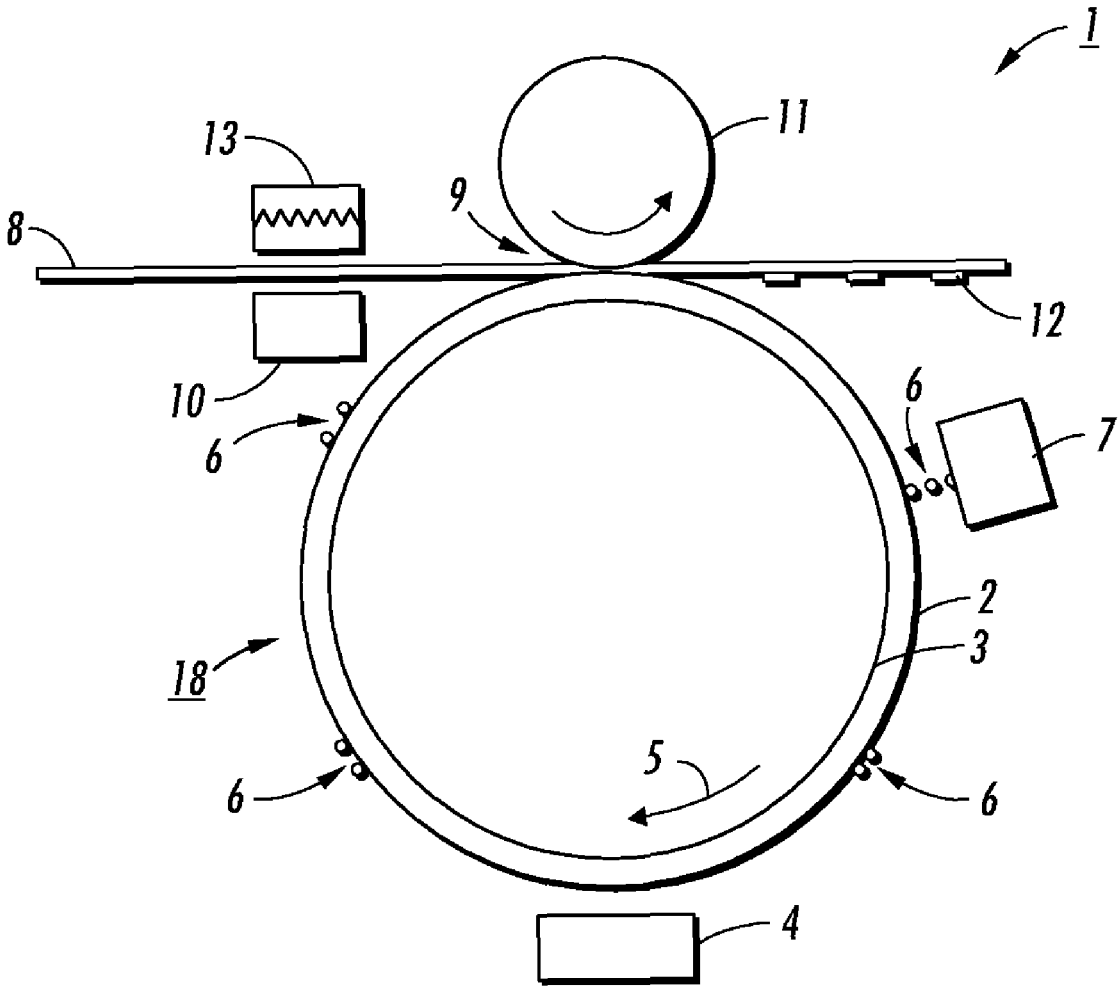
FIG. 1 is an illustration of a phase change ink apparatus.

Referring to FIG. 1, offset printing apparatus 1 is demonstrated to show transfer of an ink image from the imaging member to a final printing medium or receiving substrate. As the imaging member 18 turns in the direction of arrow 5, a liquid surface 2 is deposited on imaging/transfix member 18. The imaging/transfix member 18 is depicted in this embodiment as a drum member. However, it should be understood that other embodiments can be used, such as a belt member, film member, sheet member, or the like. The liquid layer 2 is deposited by an applicator 4 that may be positioned at any place, as long as the applicator 4 has the ability to make contact and apply liquid surface 2 to imaging/transfix member 18.

The ink used in the printing process can be a phase change ink, such as, for example, a solid ink. The term "phase change ink" means that the ink can change phases, such as a solid ink becoming liquid ink or changing from solid into a more malleable state. Specifically, in embodiments, the ink can be in solid form initially, and then can be changed to a molten state by the application of heat energy. The solid ink may be solid at room temperature, or at about 25° C. The solid ink may possess the ability to melt at relatively high temperatures above from about 85° C. to about 150° C. The ink is melted at a high temperature and then the melted ink 6 is ejected from printhead 7 onto the liquid layer 2 of imaging/transfix member 18. The ink is then cooled to an intermediate temperature of from about 20° C. to about 80° C., or about 72° C., and solidifies into a malleable state in which it can then be transferred onto a final receiving substrate 8 or print medium 8.

The ink has a viscosity of from about 5 to about 30 centipoise, or from about 8 to about 20 centipoise, or from about 10 to about 15 centipoise at about 140° C. The surface tension of suitable inks is from about 23 to about 50 dynes/cm. Examples of suitable inks for use herein include those described in U.S. Pat. Nos. 4,889,560; 5,919,839; 6,174,937; and 6,309,453, the disclosure each of which are hereby incorporated by reference in their entirety.

Some of the liquid layer 2 is transferred to the print medium 8 along with the ink. A typical thickness of transferred liquid is about 100 angstroms to about 100 nanometer, or from about 0.1 to about 200 milligrams, or from about 0.5 to about 50 milligrams, or from about 1 to about 10 milligrams per print medium.

Suitable liquids that may be used as the imaging/transfix print liquid surface 2 include water, fluorinated oils, glycol, surfactants, mineral oil, silicone oil, functional oils, and the like, and mixtures thereof. Functional liquids include silicone oils or polydimethylsiloxane oils having mercapto, fluoro, hydride, hydroxy, and the like functionality.

Feed guide(s) 10 and 13 help to feed the print medium 8, such as paper, transparency or the like, into the nip 9 formed between the pressure member 11 (shown as a roller), and imaging/transfix member 18. It should be understood that the pressure member can be in the form of a belt, film, sheet, or other form. In embodiments, the print medium 8 is heated prior to entering the nip 9 by heated feed guide 13. When the print medium 8 is passed between the transfix printing medium 3 and the pressure member 11, the melted ink 6 now in a malleable state is transferred from the imaging/transfix member 18 onto the print medium 8 in image configuration. The final ink image 12 is spread, flattened, adhered, and fused or fixed to the final print medium 8 as the print medium moves between nip 9. Alternatively, there may be an additional or alternative heater or heaters (not shown) positioned in association with offset printing apparatus 1. In another embodiment, there may be a separate optional fusing station located upstream or downstream of the feed guides.

The pressure exerted at the nip 9 is from about 100 to about 1,500 psi, or from about 800 to about 1,200 psi, or from about 900 to 1,100. This is approximately twice the ink yield strength of about 250 psi at 50° C. In embodiments, higher temperatures, such as from about 72° C. to about 75° C. can be used, and at the higher temperatures, the ink is softer. Once the ink is transferred to the final print medium 8, it is cooled to an ambient temperature of from about 20° C. to about 25° C. Stripper fingers (not shown) may be used to assist in removing the print medium 8 having the ink image 12 formed thereon to a final receiving tray (also not shown).

Figure 2:
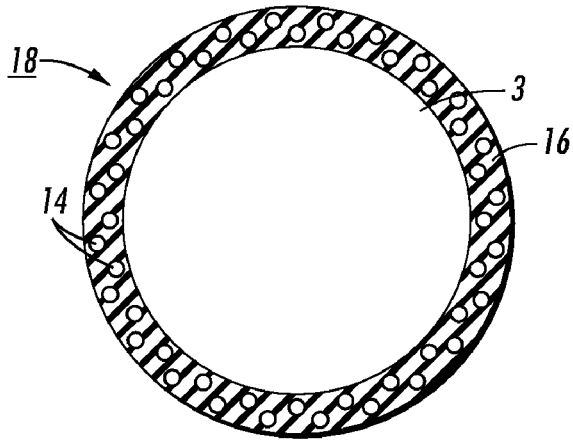
FIG. 2 is an enlarged view of an embodiment of a transfix/imaging drum having a substrate and an outer layer thereon.

FIG. 2 demonstrates a single layer embodiment herein, wherein transfix member 18 comprises substrate 3, having there over outer coating 16. Fillers 14 are dispersed or contained therein.

Figure 3:
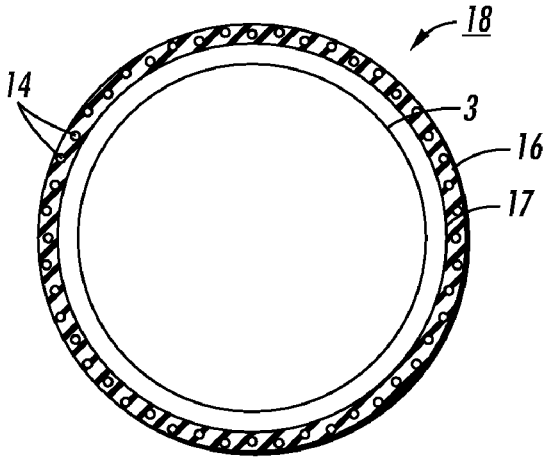
FIG. 3 is an enlarged view of an embodiment of an imaging/transfix drum having a substrate, and optional intermediate layer, and an outer layer thereon.

FIG. 3 depicts a dual-layer embodiment herein, wherein the transfix member 18 comprises a substrate 3, intermediate layer 17 positioned on the substrate 3, and outer layer 16 positioned on the intermediate layer 17. If the substrate is included, this configuration is sometimes referred to as a three-layer configuration. Fillers 14 are dispersed or contained therein.

Outer layer 16 comprises a polyurethane and conductive salt, such as an ionically conductive salt. The term "ionically conductive salt" is defined herein. The term "ionically" refers to the conductivity that is imparted by addition of ions which could be both positively or negatively charged. The term "conductive" refers to moving electrical charges by electrons or holes. The term "salt" refers to a chemical compound comprising a positive charge (cation) and a negative charge (anion). The term "ionically conductive salt" refers to a chemical compound containing both a cation and an anion. These salts can be used to impart electrical conductivity to polymeric matrixes.

Similarly, for the electronically conductive case, the pressure member 18 includes an outer layer 16. Outer layer 16 can comprise electronically conducting polyurethane, silicones, ethylene propylene dienemethylene terpolymer (EPDM), nitrile butadiene (NBR) (a copolymer of butadiene and acrylonitrile), or mixtures thereof. The electrical conductivity is built in by adding electronically conducting particulate fillers, such as carbon fillers, metal oxide filler, polymer fillers, and the like. Examples of carbon fillers include carbon black, carbon nanotubes, fluorinated carbon black, graphite and the like. Examples of metal oxides include tin oxide, indium oxide, indium tin oxide, and the like. Examples of polymer fillers include polyanilines, polyacetylenes, polyphenylenes polypyrroles, and the like. The term "electrically conductive particulate fillers" refers to the fillers which have intrinsic electrical conductivity. These can be added to a polymer matrix to impact electrical conductivity.

Examples of suitable polyurethanes include polysiloxane-based polyurethanes fluoropolymer-based urethanes, polyester-based polyurethanes polyether-based polyurethanes and polycaprolactone-based polyurethanes, available from Uniroyal, Bayer, Conap, and the like.

The ionically conducting polyurethanes can be prepared by any of the known methods. One method includes making conductive polyurethanes by mixing chain extenders (polyol or polyamine) into an isocyanate functional prepolymer with a solution of a metal salt. Isocyanate-terminated polyester polyol prepolymers can be used. This is followed by heat curing to yield the final conducting polyurethane elastomers.

A conductive salt or ionically conductive salt is present in the polyurethane material. Examples of conductive salts or ionically conductive salts include quaternary ammonium salts, phosphonium salts, sulphonium salts, transition metal salts, and carbonium salts. Specifically, conductive salts can include transition metal, ammonium salts, and sulphonium salts. In the case of transition metal salts, the transition metal salt may comprise a transition metal selected from the group consisting of Cu (II), Fe (III), Ni (II), Zn (II), and Co (II), and a counter-anion can be selected from acetate, tartrate, lactate, phosphate, oxalate, fluoride, chloride, bromide, iodide, and the like, and mixtures thereof. In embodiments, the transition metal is selected from Cu (II), Fe (III), and mixtures thereof, and the counter anion is selected from bromides, chlorides, acetates, and mixtures thereof.

The most common method of preparing conducting polyurethanes includes mixing/dissolving the desired ionic salt in appropriate amounts into one of the starting components of the reactants with or without the use of heat. This is then followed by the addition of the second reactant. The salt is soluble or miscible in the components of the polyurethane outer layer material.

The salt is present in the outer layer in an amount of from about 1 to about 50, or from about 5 to about 30, or from about 5 to about 20 percent by weight of total solids in the layer.

The polyurethane material is present in the outer coating in an amount of from about 50 to about 99, or from about 70 to about 95, or from about 80 to about 95 percent by weight of total solids.

Also included in the outer coating can be solvents and optional fillers other than the conductive filler, and further the layer can include dispersion agents, co-solvents, surfactants, and the like.

In the two-layer configuration, i.e., an intermediate layer and an outer layer, the thickness of the outer layer is from about 1 to about 200, or from about 25 to about 100, or from about 25 to about 75 microns. In the single layer embodiment, the outer layer thickness is from about 1 to about 50 mm, or from about 1 to about 20 mm, or from 2 to 10 mm.

The outer layer of both configurations (one layer or two layers) has an electrical conductivity of from about $10^3$ to about $10^8$ ohm-cm, or from about $10^4$ to about $10^7$ ohm-cm, or from about $10^5$ to about $10^6$ ohm-cm.

The substrate, optional intermediate layer, and/or outer layer, in embodiments, may comprise additives, such as those just described, dispersed therein, or a filler different than the conductive salt, such as metals; metal oxides such as alumina, silica, copper oxide and the like; carbon fillers such as carbon black, fluorinated carbon and the like; and polymer fillers such as polytetrafluoroethylene powders.

The imaging/transfix member substrate can comprise any material having suitable strength for use as an imaging/transfix member substrate. Examples of suitable materials for the substrate include metals, rubbers, fiberglass composites, and fabrics. Examples of metals include steel, aluminum, nickel, and their alloys, and like metals, and alloys of like metals. The thickness of the substrate can be set appropriate to the type of imaging member employed. In embodiments wherein the substrate is a belt, film, sheet or the like, the thickness can be from about 0.5 to about 500 mils, or from about 1 to about 250 mils. In embodiments wherein the substrate is in the form of a drum, the thickness can be from about 1/32 to about 1 inch, or from about 1/16 to about 5/8 inch.

Examples of suitable transfix substrates include a sheet, a film, a web, a foil, a strip, a coil, a cylinder, a drum, an endless strip, a circular disc, a belt including an endless belt, an endless seamed flexible belt, an endless seamless flexible belt, an endless belt having a puzzle cut seam, a weldable seam, and the like.

In an optional embodiment, an intermediate layer may be positioned between the imaging/transfix substrate and the outer layer. Materials suitable for use in the intermediate layer include urethanes, silicone materials, fluoroelastomers, fluorosilicones, ethylene propylene diene rubbers, and the like, and mixtures thereof. In embodiments, the intermediate layer is conformable and is of a thickness of from about 2 to about 60 mils, or from about 4 to about 25 mils.

In embodiments, the water contact angle is above about 100° C. The coating has a high wear resistance of from about 1 million to about 3 million prints. Moreover, the coating has a smooth surface, having a surface roughness Ra of less than about 5 microns.

The pressure member 11 is positioned on an opposite contact side from the imaging/transfix member 18. The pressure member may comprise a substrate and an outer polyurethane layer positioned on the substrate and may have a modulus of from about 8 to about 300 MPa, and a thickness of from about 0.3 to about 10 mm, and wherein the pressure exerted at the nip is from about 750 to about 4,000 psi, or from about 800 to about 4,000 psi, or from about 900 to about 4,000 psi, or from about 1,100 to about 4000 psi, or from about 900 to about 1,200 psi.

The process for producing the outer coating includes cleaning the roll with isopropyl alcohol (IPA), followed by masking the journal ends. The roll may be flow-coated with one pass of coating using program #8 on flow coater, 120 rpm/60 rps using small pump on Ismatek. This can be followed by flash for about 15 minutes, and followed by oven cure: 400 F, 15 minutes. The roll can be flipped on the coater to minimize end effects. The roll is then flow-coated with a second pass of coating, followed by air flash for about 15 minutes. This is followed by oven cure: 400 F, 15 minutes, and is then cooled.

The following Examples further define and describe embodiments herein. Unless otherwise indicated, all parts and percentages are by weight.

EXAMPLES

Example 1

Preparation of Pressure Member with an Electronically Conducting Overcoat

Figure 4:
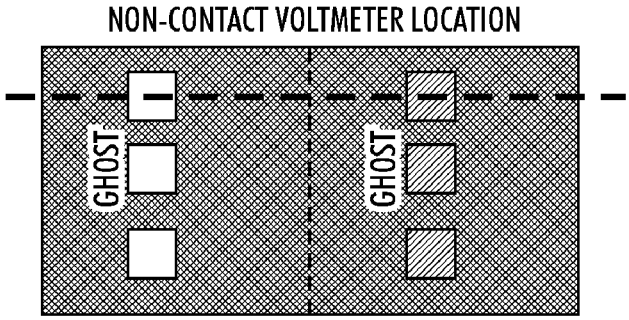
FIG. 4 is a print showing how roller ghosting manifests itself on the duplex image as well as the physical location of a non-contact voltmeter measuring the surface potential of the roll surface.
Figure 5:
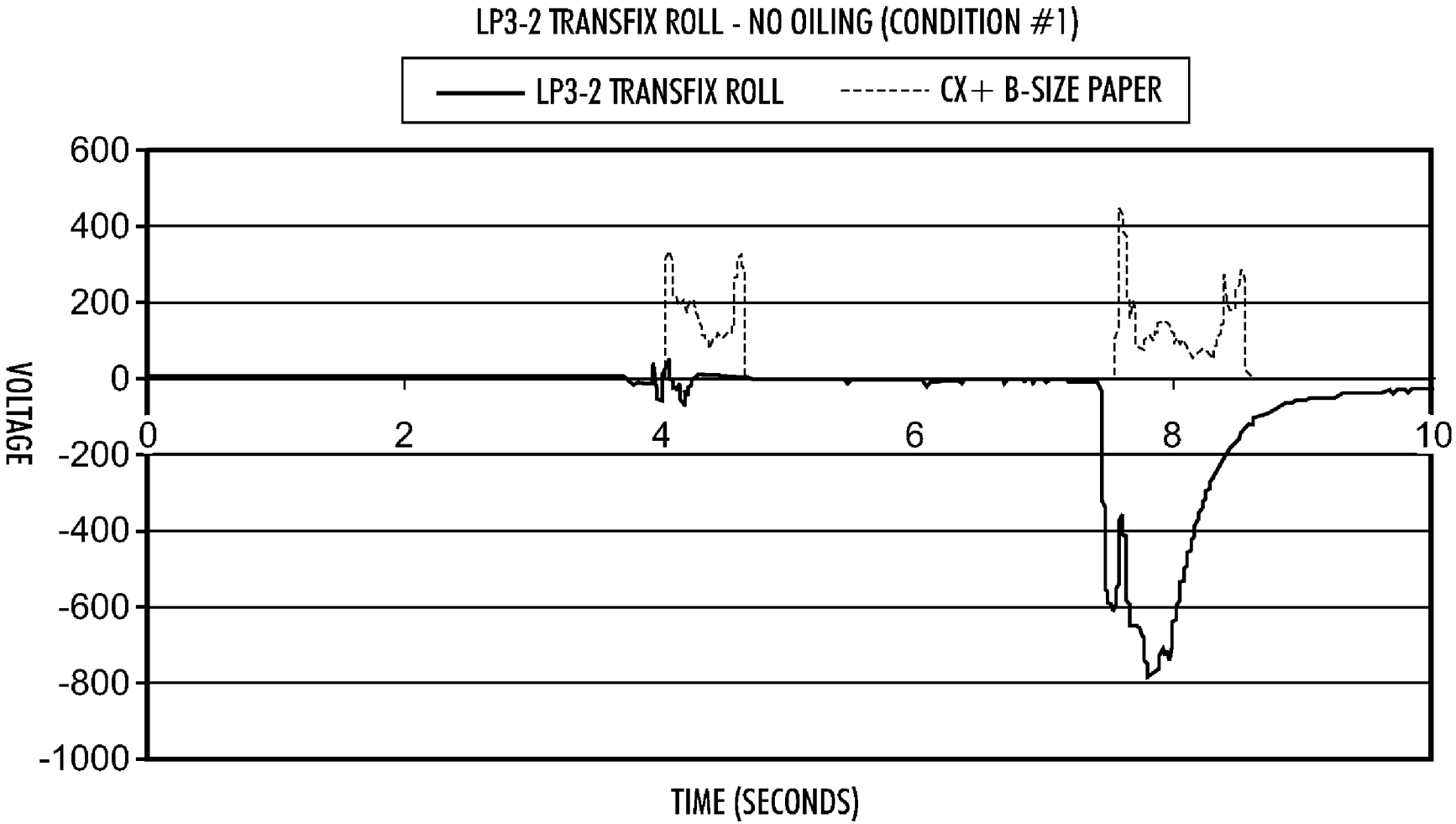
FIG. 5 is a graph of voltage versus time and demonstrates the surface potential for one complete duplex print in the solid ink jet process.
Figure 6:
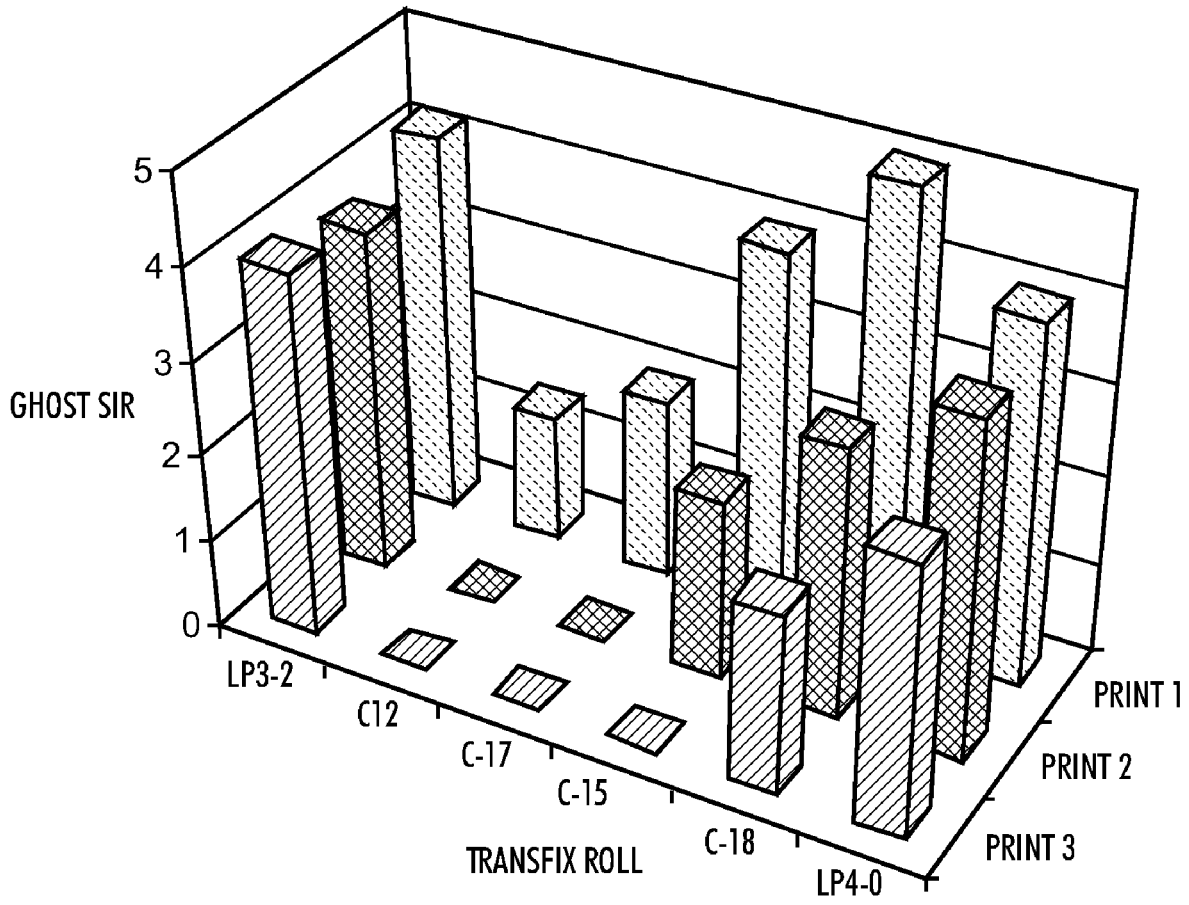
FIG. 6 is a bar graph showing ghosting performance versus print number for different pressure rolls which include non-conductive and conductive surfaces.
Figure 7A:
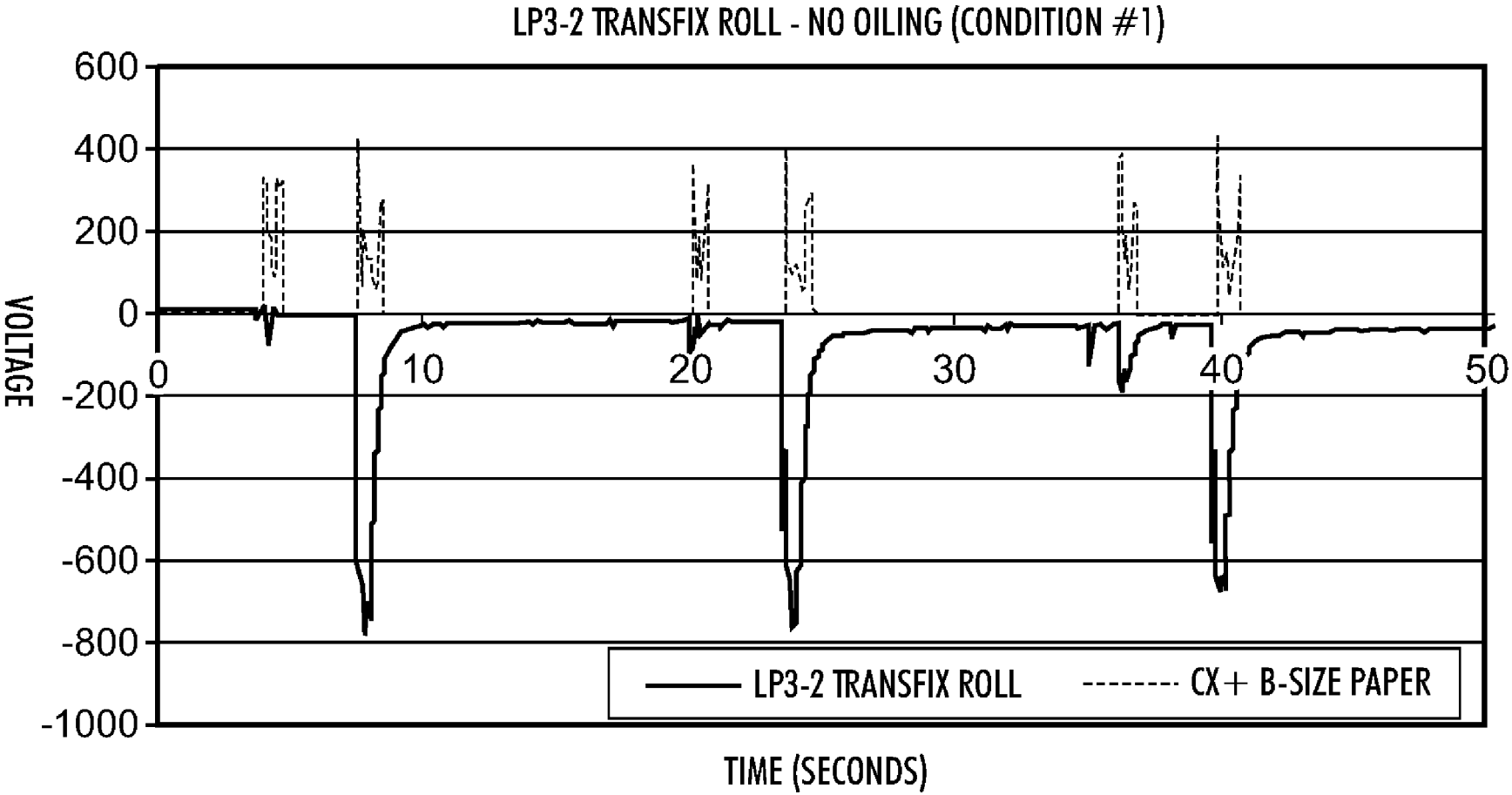
FIG. 7*a* shows roll surface voltage versus time for the standard non-conductive roll and FIG. 7*b* shows roll surface voltage versus time for a conductive roll.
Figure 7B:
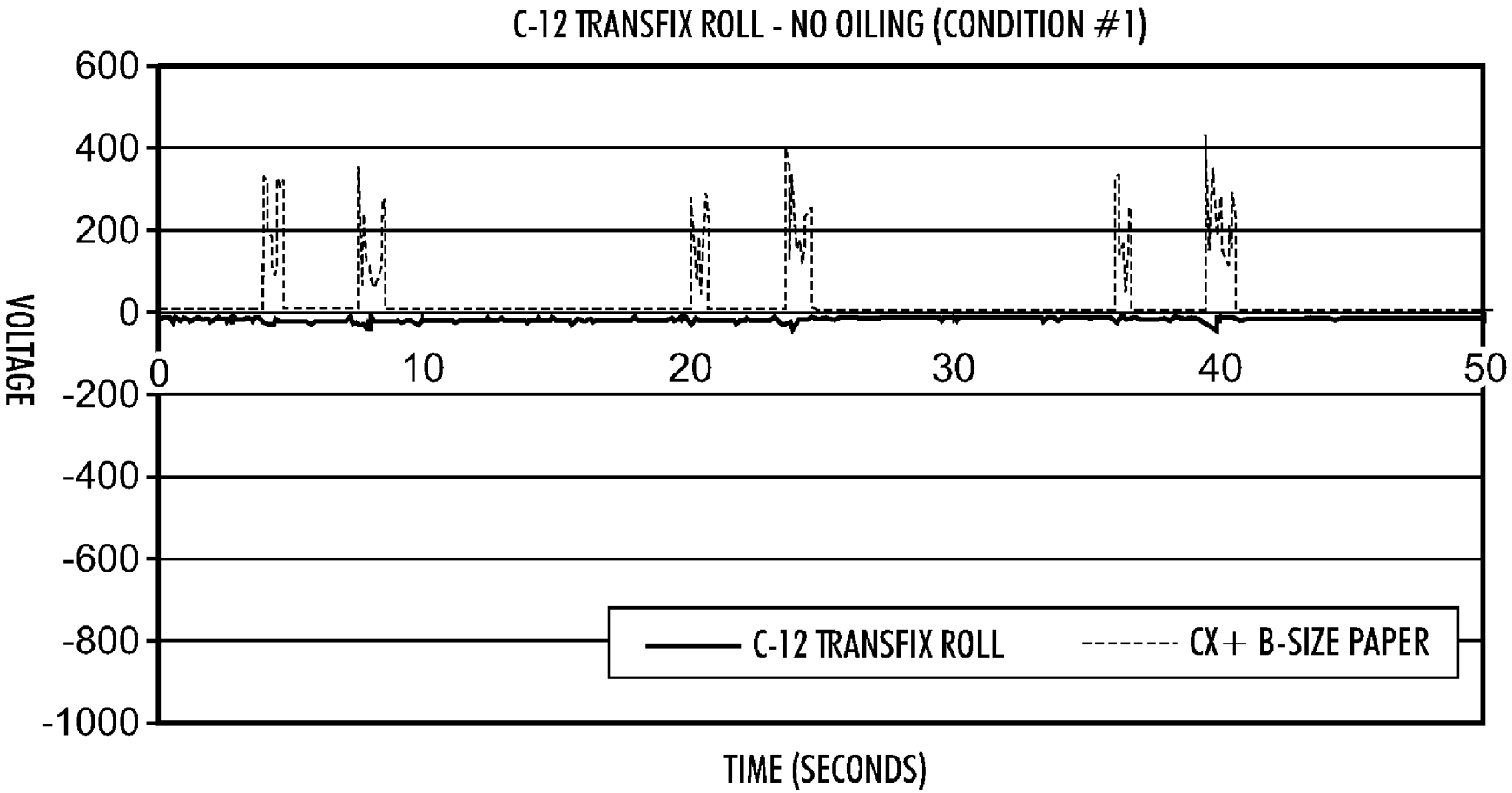

Polyurethane rollers were made to have a conductive surface layer by applying a high carbon filled coating on the surface. These rollers were tested against the standard non-conductive urethane rollers using standard procedures. FIG. 4 shows the manifestation of the gloss ghost, a common defect, and the dotted line represents where on the pressure roll the surface voltage is measured. FIG. 5 shows the pressure roll surface voltage versus time for the standard non-conductive roller. The figure shows gloss ghosting while printing in duplex, by demonstrating the results of testing of Lp3-2 (non-conducting rollers). FIG. 6 includes data for pressure rolls C-12 and C-17, having conductive surfaces, and demonstrates that the gloss ghost is minimized when compared to standard non-conductive rolls (Lp3). The C-15 roller comprises polyurethane one-layer configuration with a fluoropolymer filler. Roller C-18 is a non-conductive roller. The Lp4-0 roller is a standard production roller. FIG. 7*b* demonstrates that the surface voltage versus time for pressure roll C-12 is essentially zero for the conductive surface versus several hundred volts. FIG. 7*a* demonstrates the high ghosting of Lp3-2 non-conducting roller, versus the low-ghosting shown in FIG. 7*b* for conducting rollers C-12. These figures demonstrate the effectiveness of a conductive surface.

Example 2

Preparation of Pressure Member Having a Hybrid Configuration of Polyester-Based Polyurethane Underlayer and Electronically Conductive NBR A carbon steel core having an inner diameter of 44.5 mm, an outer diameter of 66.2 mm, and a length of 445 mm from Northwest Machine Works of Canby, Oreg., was degreased and cleaned by known methods. A primer layer of 0.002 inches was spray coated onto this core. A polyester-based polyurethane composition was prepared by reacting an isocyanate end-capped prepolymer with a functional crosslinking agent in the presence of an appropriate catalyst. Test specimens were prepared for mechanical property testing according to standard test protocol. The elastic modulus at ambient temperature was found to be 199 MPa, which did not change more than 36.7 percent when tested up to 72° C., and did not change more than 23.1 percent when tested at 50° C. The intermediate layer was cast by a flow coating method. The layer was then machined to uniform thickness by grinding. The thickness of the layer was 1.5 mm.

The machined layer was then primed and a conductive outer layer comprising of nitrile butadiene rubber (NBR) and either 15% or 35% carbon black by weight, were molded by known procedures. The thickness of the outer layer was determined to be about 0.4 mm. The mechanical property testing of the sample buttons standard ASTM test protocol from this material would indicate the elastic modulus to be about 15 MPa at ambient temperature. The material showed approximately uniform modulus across temperatures to 75° C. The outer layer was then profile ground to achieve a convex radius of about 200 meters.

Figure 8:
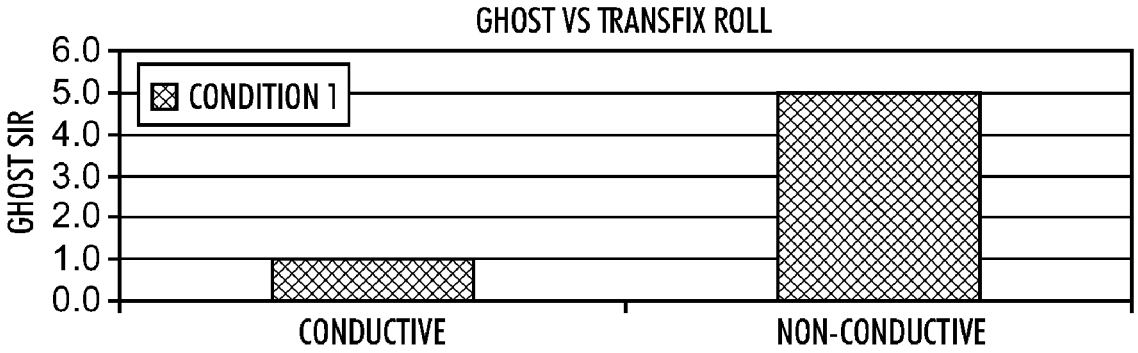
FIG. 8 is a graph showing differences in ghosting performance for non-conductive and conductive rolls.

This roll when installed in a printing test fixture, which applied about a 1,500 to about 2,000 pound load, resulted in a pressure at the nip of from about 800 to about 1,200 psi. The roll on print testing demonstrated acceptable print quality performance as measured by standard metrics and in comparison to previous solid ink products. FIG. 8 shows minimized gloss ghost of a conductive roller as compared to a non-conductive polyurethane.

Example 3

Preparation of Pressure Member Having Ionically Conductive Polyurethane for the Transfix Process A carbon steel core having an inner diameter of 44.5 mm, an outer diameter of 66.2 mm, and length of 445 mm from Northwest Machine Works of Canby, Oreg., was degreased and cleaned by known methods. A primer layer of 0.002 inches was spray coated onto this core. A polyester-based polyurethane composition was prepared by reacting an isocyanate end-capped prepolymer with a functional crosslinking agent in the presence of an appropriate catalyst. Test specimens were prepared for mechanical property testing according to standard test protocol. The elastic modulus at ambient temperature was found to be 199 MPa, which did not change more than 36.7 percent when tested up to 72° C., and did not change more than 23.1 percent when tested at 50° C. The intermediate layer was cast by a flow coating method. The layer was then machined to uniform thickness by grinding. The thickness of the layer was 1.5 mm.

The machined layer was then primed and a conductive outer layer was flow coated with a polyester-based polyurethane prepared by a similar reaction of an isocyanate end-capped prepolymer with a functional crosslinking agent in the presence of an appropriate catalyst, with the exception that 1% and 5% by weight of a transition metal salt was added. The thickness of the outer layer was determined to be about 0.4 mm. The mechanical property testing of the sample buttons standard ASTM test protocol from this material would indicate the elastic modulus to be about 17 MPa at ambient temperature. The material showed approximately uniform modulus across temperature to 75° C. The outer layer was then profile ground to achieve a convex radius of 200 meters.

This roll when installed in a printing test fixture, which applied about a 1,500 to about 2,000 pound load resulting in about a pressure at the nip of from about 800 to about 1,200 psi. The roll on print testing demonstrated acceptable print quality performance as measured by standard metrics and in comparison to previous solid ink products.

Example 4

Preparation of Pressure Member Having Electronically Conductive Polyurethane for the Transfix Process A carbon steel core having an inner diameter of 44.5 mm, an outer diameter of 66.2 mm, and length of 445 mm from Northwest Machine Works of Canby, Oreg., was degreased and cleaned by known methods. A primer layer of 0.002 inches was spray coated onto this core. A polyester-based polyurethane composition was prepared by reacting an isocyanate end-capped prepolymer with a functional crosslinking agent in the presence of an appropriate catalyst. Test specimens were prepared for mechanical property testing according to standard test protocol. The elastic modulus at ambient temperature was found to be 199 MPa, which did not change more than 36.7 percent when tested up to 72° C. and did not change more than 23.1 percent when tested at 50° C. The intermediate layer was cast by a flow coating method. The layer was then machined to uniform thickness by grinding. The thickness of the layer was 1.5 mm.

The machined layer was then primed and a conductive outer layer was flow coated with a polyester-based polyurethane prepared by a similar reaction of an isocyanate end-capped prepolymer with a functional crosslinking agent in the presence of an appropriate catalyst with the exception that 15% and 25% by weight of carbon black was added. The thickness of the outer layer was determined to be about 0.4 mm. The mechanical property testing of the sample buttons standard ASTM test protocol from this material would indicate the elastic modulus to be about 17 MPa at ambient temperature. The material would show approximately uniform modulus across temperature to 75° C. The outer layer was then profile ground to achieve a convex radius of 200 meters.

This roll when installed in a printing test fixture, which applied about a 1,500 to about 2,000 pound load resulting in about a pressure at the nip of from about 800 to about 1,200 psi. The roll on print testing demonstrated superior print quality performance as measured by standard metrics and in comparison to previous solid ink products.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. An offset printing apparatus for transferring and optionally fixing a phase change ink onto a print medium comprising:

a) a phase change ink application component for applying a phase change ink in a phase change ink image to an imaging member;

b) an imaging member for accepting, transferring and optionally fixing the phase change ink image to said print medium, the imaging member comprising:

i) an imaging substrate, and thereover ii) an outer coating comprising a conductive polyurethane for reduction of gloss ghost comprises a polyurethane and a conductive salt, wherein the conductive polyurethanes is prepared by mixing polyol or polyamine into an isocyanate-functional prepolymer with a solution of a conductive salt; and c) a release agent management system for supplying a release agent to said imaging member;

wherein said outer layer has an electrical conductivity of from about $10^3$ to about $10^8$ ohm-cm.

2. The offset printing apparatus of claim 1, wherein said polyurethane is selected from the group consisting of polysiloxane-based polyurethanes, fluoropolymer-based urethanes, polyester-based polyurethanes, polyether-based polyurethanes, and polycaprolactone-based polyurethanes.

3. The offset printing apparatus of claim 1, wherein said conductive salt is selected from the group consisting of quaternary ammonium salts, phosphonium salts, sulphonium salts, transition metal salts, and carbonium salts.

4. The offset printing apparatus of claim 1, wherein said conductive salt is a transition metal salt comprising a transition metal and a counter anion.

5. The offset printing apparatus of claim 4, wherein said transition metal is selected from the group consisting of Cu (II), Ni (II), Zn (II), Co (II) and Fe (III), and wherein said counter anion is selected from the group consisting of bromides, chlorides, and acetates.

6. The offset printing apparatus of claim 5, wherein said transition metal is Cu (II), Ni (II), Zn (II) and Co(II).

7. The offset printing apparatus of claim 1, wherein said conductive salt is present in the outer layer in an amount of from about 1 to about 50 percent by weight of total solids.

8. The offset printing apparatus of claim 7, wherein said conductive salt is present in the outer layer in an amount of from about 5 to about 30 percent by weight of total solids.

9. The offset printing apparatus of claim 1, wherein said outer layer has an electrical conductivity of from about $10^5$ to about $10^6$ ohm-cm.

10. The offset printing apparatus of claim 1, wherein said electrical conductivity is from about $10^4$ to about $10^7$ ohm-cm.

11. The offset printing apparatus of claim 1, wherein said outer layer has a thickness of from about 1 to about 50 mm.

12. The offset printing apparatus of claim 11, wherein said outer layer has a thickness of from about 1 to about 20 mm.

13. The offset printing apparatus of claim 1, wherein an intermediate layer is positioned between said substrate and said outer layer.

14. The offset printing apparatus of claim 1, wherein said phase change ink is solid at about 25° C.

15. The offset printing apparatus of claim 1, wherein the print medium comprises paper.

16. The offset printing apparatus of claim 1, wherein the imaging member is a roller.

17. The offset printing apparatus of claim 1, wherein said print medium is fed into a nip.

18. The offset printing apparatus of claim 17, wherein a pressure exerted at said nip is from about 800 to about 4,000 psi.

19. The offset printing apparatus of claim 18, wherein said pressure exerted at said nip is from about 900 to about 1,200 psi.

20. An offset printing apparatus for transferring and optionally fixing a phase change ink onto a print medium comprising:

a) a phase change ink application component for applying a phase change ink in a phase change ink image to an imaging member;

b) an imaging member for accepting, transferring and optionally fixing the phase change ink image to said print medium, the imaging member comprising:

i) an imaging substrate, and thereover ii) an outer coating comprising a polyester-based polyurethane and a transition metal salt for reduction of gloss ghost, wherein said outer layer has an electrical conductivity of from about $10^3$ to about $10^8$ ohm-cm; and c) a release agent management system for supplying a release agent to said imaging member.

21. An offset printing apparatus for transferring and optionally fixing a phase change ink onto a print medium comprising:

a) a phase change ink application component for applying a phase change ink in a phase change ink image to an imaging member;

b) an imaging member for accepting, transferring and optionally fixing the phase change ink image to said print medium, the imaging member comprising:

i) an imaging substrate, and thereover ii) an outer coating comprising a polyurethane and ionically conductive salt for reduction of gloss ghost, wherein said outer layer has an electrical conductivity of from about $10^3$ to about $10^8$ ohm-cm; and c) a release agent management system for supplying a release agent to said imaging member.

* * * * *